US007036786B1

(12) United States Patent
Schura

(10) Patent No.: US 7,036,786 B1
(45) Date of Patent: May 2, 2006

(54) MOUNTING SYSTEM

(75) Inventor: Christopher Schura, Greenwood, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 8 days.

(21) Appl. No.: 10/672,273

(22) Filed: Sep. 26, 2003

(51) Int. Cl.
*A47B 91/00* (2006.01)

(52) U.S. Cl. ..... 248/346.03; 248/503; 52/DIG. 11

(58) Field of Classification Search ..... 248/346.01, 248/346.02, 346.03, 346.3, 500, 503, 680, 248/681; 249/219.1, 2–8; 52/127.1, 127.2, 52/146, DIG. 11; 410/77, 80; 224/545, 224/557, 42.37, 42.4, 42.32
See application file for complete search history.

(56) References Cited

U.S. PATENT DOCUMENTS

| | | | | |
|---|---|---|---|---|
| 2,313,880 | A * | 3/1943 | Leggett, Sr | 249/27 |
| 2,363,917 | A * | 11/1944 | Waterman et al. | 135/116 |
| 2,904,850 | A * | 9/1959 | Couse et al. | 52/36.2 |
| 3,154,832 | A * | 11/1964 | Weidner | 249/10 |
| 3,428,287 | A * | 2/1969 | Redding et al. | 249/13 |
| 4,723,752 | A * | 2/1988 | Thomas | 249/219.1 |
| 5,069,418 | A * | 12/1991 | Jennings | 249/210 |
| 5,076,536 | A * | 12/1991 | Fitzgerald | 249/219.1 |
| 5,285,604 | A * | 2/1994 | Carlin | 52/79.1 |
| 5,817,247 | A * | 10/1998 | Colatruglio | 249/4 |
| 5,843,327 | A * | 12/1998 | Lindgren | 249/210 |
| 6,202,383 | B1 | 3/2001 | Reiter | |
| 6,349,510 | B1 | 2/2002 | Haas et al. | |
| 6,582,035 | B1 | 6/2003 | Lucht et al. | |
| 2001/0037615 | A1 * | 11/2001 | Riech | 52/79.1 |

FOREIGN PATENT DOCUMENTS

| | | | |
|---|---|---|---|
| EP | 1468939 | A * | 4/2003 |

* cited by examiner

*Primary Examiner*—Korie Chan
(74) *Attorney, Agent, or Firm*—Mark O. Glut; Naval Air Systems Company

(57) ABSTRACT

A mounting system for a shelter, which includes an angle assembly and a supporting understructure. The angle assembly is mountable on longitudinal sides of the shelter. The shelter is mountable on the understructure, the angle assembly is attached to the understructure.

1 Claim, 9 Drawing Sheets

MOUNTING SYSTEM

STATEMENT OF GOVERNMENT INTEREST

The invention described herein may be manufactured and used by or for the Government of the United States of America for governmental purposes without payment of any royalties thereon or therefor.

BACKGROUND

The present invention relates to a mounting system. More specifically, but without limitation, the present invention relates to a mounting system for military shelters.

Military operations often require a shelter that is easily transported. Shelters are often modified and populated with electronics, and other equipment, to satisfy a mission peculiar application. Standard shelters come equipped with a limited number of tie down and lift provisions. Typically each shelter comes equipped with one tie-down and one lift ring located at each corner.

Shelters can be transported by air, ground or sea. When transported by air, shelters are secured to an airborne certified mission pallet, and the pallet is secured to the aircraft's cargo handling system rails and detents. At the time military shelters were introduced to the United States military, shelter tie down provisions were sufficient for structurally securing the shelter in the cargo area of an aircraft. However, command evaluation of military aircraft service history has resulted in more restrictive crash load criteria. This criteria enhances survivability in the event of a hull loss incident, but limits the applications of newly modified shelters without the installation of additional tie-down points on the shelter and/or structural modifications/re-designs. This results in weight increases to accommodate hard point additions in the shelter frame, in addition to the weight of the pallet itself. In addition, this adds additional problems of prepositioning the pallets, as well as additional wear and tear on the pallets and aircraft, as well as risks in the shelter shifting in transit.

Ground transportation of shelters requires the use of chain tie-down assemblies to secure the shelter to a transport vehicle. Use of chains presents a safety risk for shelter shifting in transit.

Thus, there is a need in the art to provide a mounting system for shelters that incorporates the listed benefits without the limitations inherent in present methods.

SUMMARY

The instant invention is directed to a mounting system that satisfies the needs enumerated above and below.

The present invention is directed to a mounting system that includes an angle assembly and a supporting understructure. The angle assembly is mountable on longitudinal sides of the shelter and the shelter is mountable on the understructure. The angle assembly is attached to the understructure.

The present invention is directed to a mounting system that allows a shelter to be installed on transport equipment with a standard cargo handling system.

The present invention is directed to a mounting system that minimizes use of special handling equipment or special mounting equipment such as pallets or chains.

The present invention is directed to a mounting system that ties into the main frame of the shelter.

The present invention is directed to a mounting system that minimizes wear and tear on transport equipment.

DRAWINGS

These and other features, aspects and advantages of the present invention will become better understood with reference to the following description and appended claims, and accompanying drawings wherein:

DESCRIPTION

Figure 1A:
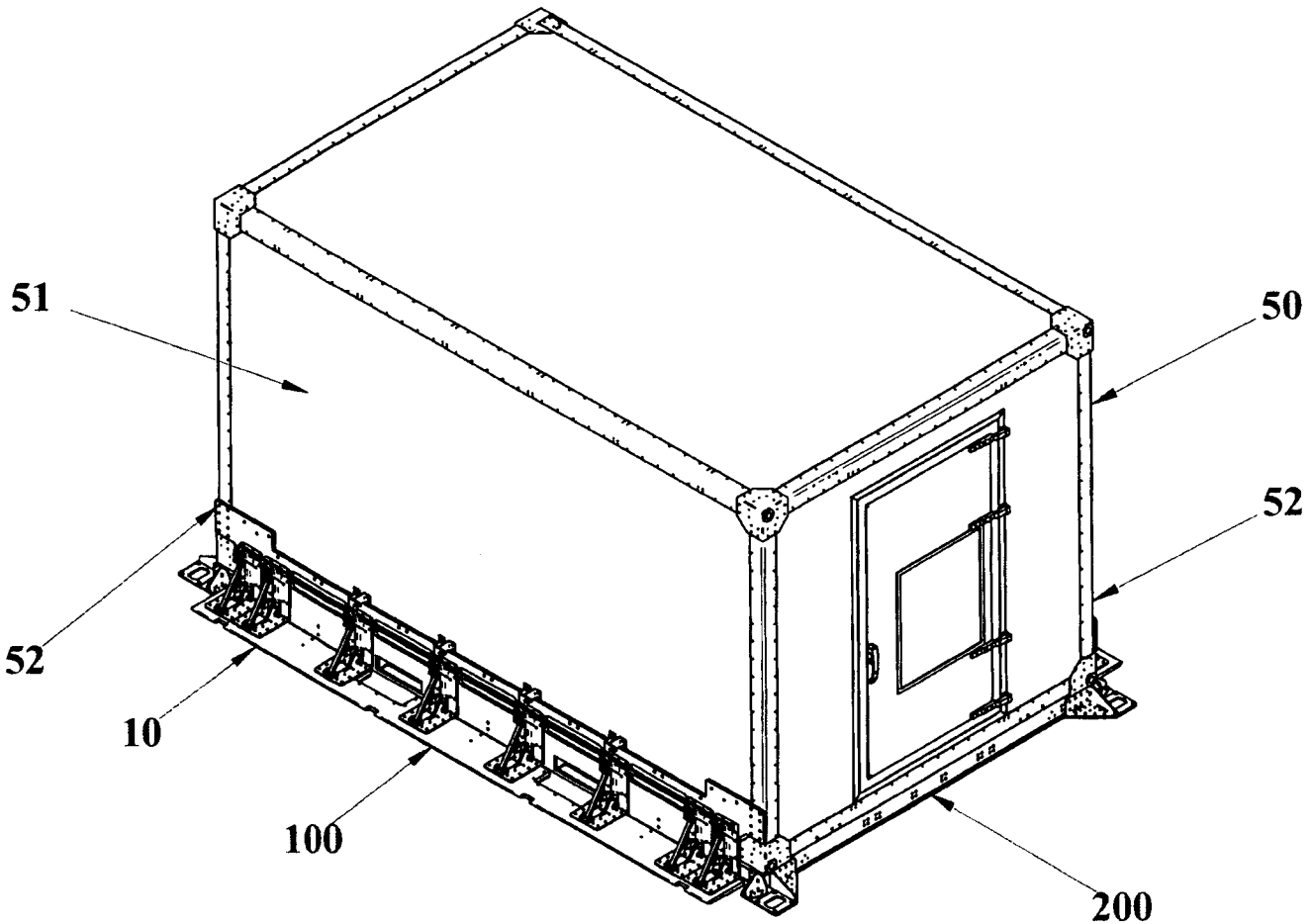
FIG. 1A is a top perspective view of an embodiment of the mounting system for a shelter with the shelter attached to the mounting system.
Figure 1B:
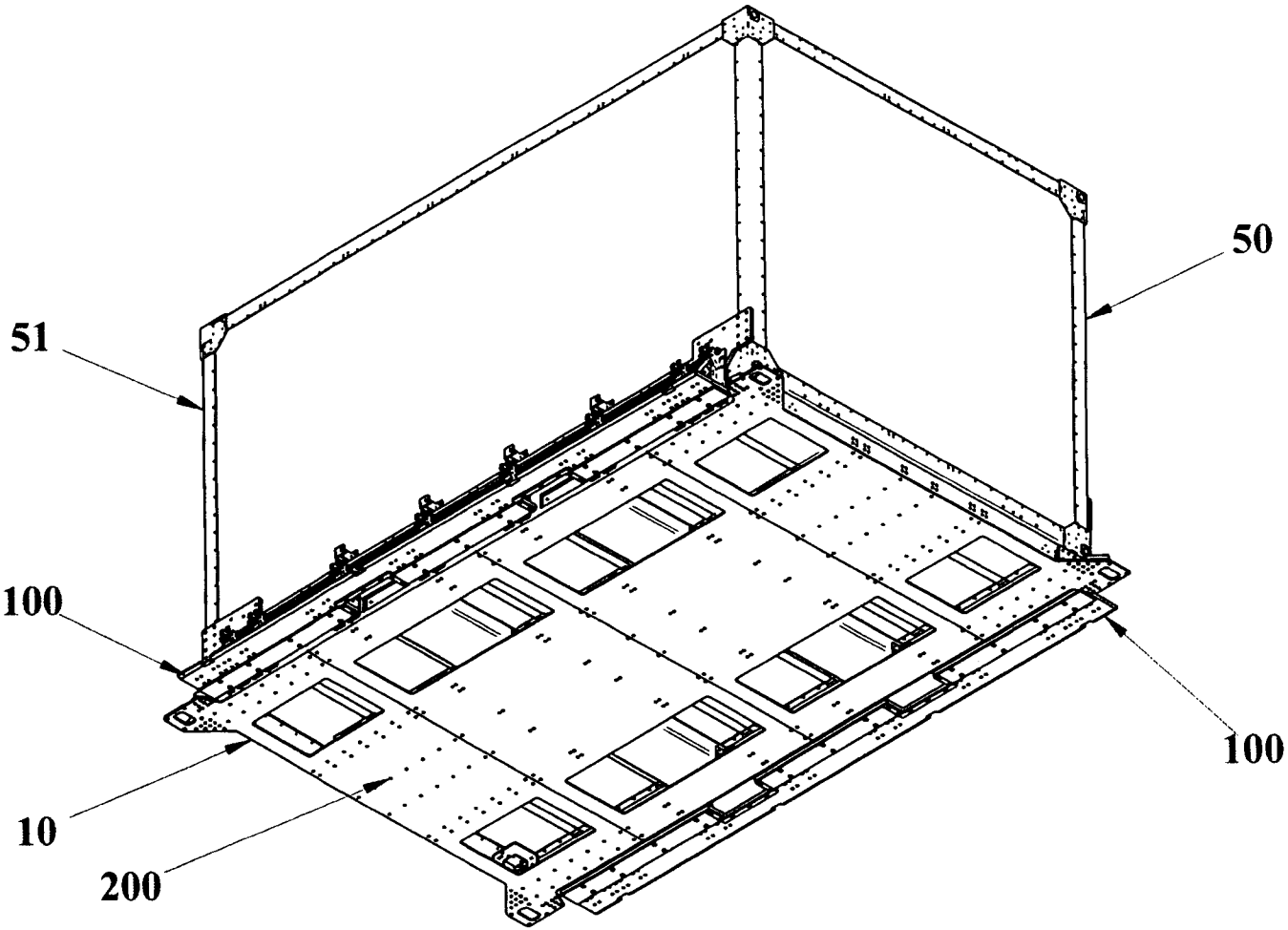
FIG. 1B is a bottom perspective view of an embodiment of the mounting system for a shelter with the shelter attached to the mounting system.
Figure 2:
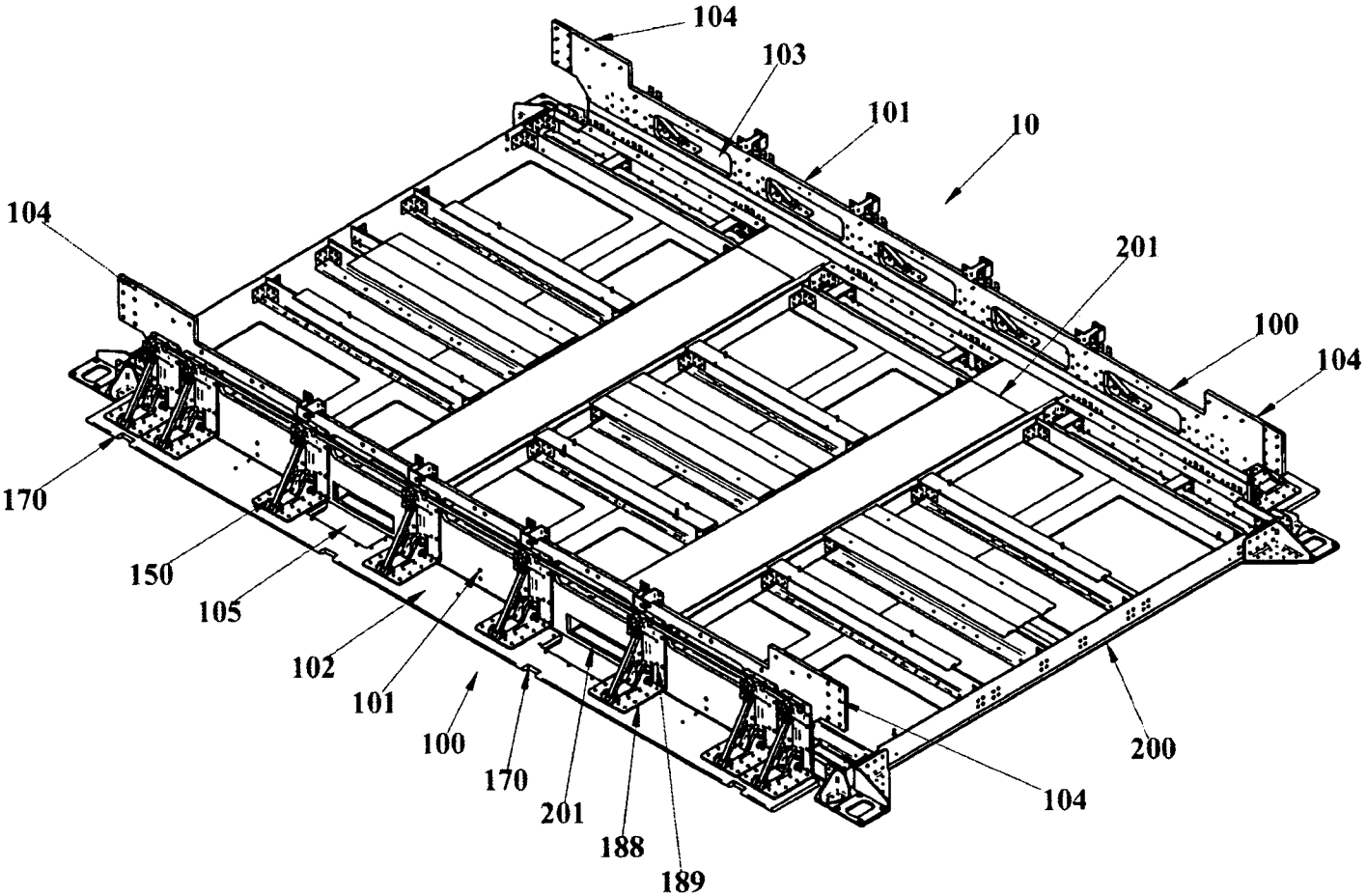
FIG. 2 is a top perspective view of an embodiment of the mounting system for a shelter.

The preferred embodiment of the present invention is illustrated by way of example below and in FIGS. 1–7. As seen in FIGS. 1A, 1B and 2, the mounting system for a shelter 10 includes an angle assembly 100 and a supporting understructure 200. The angle assembly 100 is mountable on longitudinal sides 51 of the shelter 50, specifically the bottom portion 52 of the longitudinal sides 51. The shelter 50 is mountable on the understructure 200. The angle assembly 100 is attached to the understructure 200.

In the discussion of the present invention, the invention will be discussed in a military shelter environment; however, as stated earlier, this invention can be utilized for any type of shelter that needs to be transported such as, but without limitations, a communications shelter, an emergency disaster shelter, a command/office shelter, temporary housing, cargo containers, and the like. The invention will also be discussed in an aircraft environment; however, the invention may be utilized when the shelter is transported by any transport device such as, but without limitation, a plane, a ship, a train, or any other type of transport vehicle.

Figure 3:
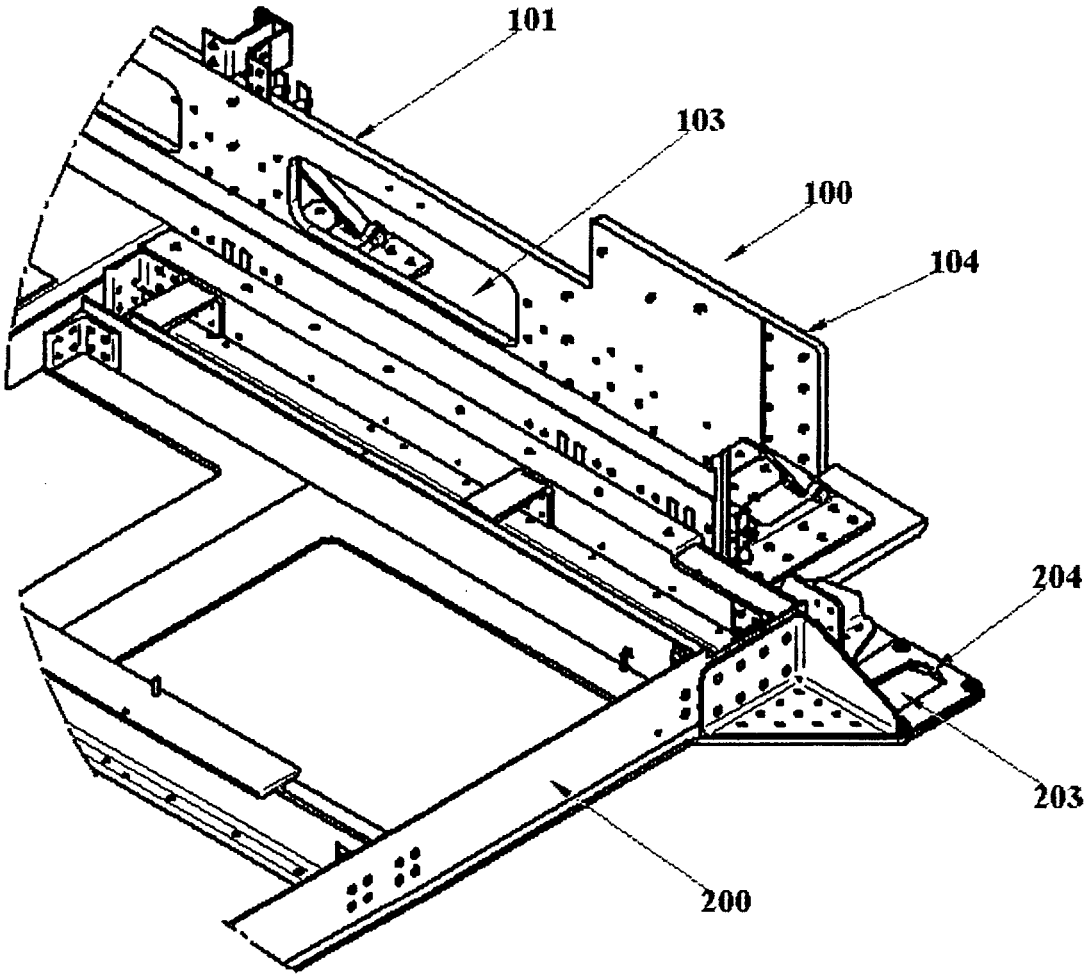
FIG. 3 is a top perspective view of a corner section of an embodiment of the mounting system.

In the preferred embodiment, the angle assembly 100 is a self contained angle assembly. As seen in FIGS. 2 and 3, the self contained angle assembly 100 includes a side base plate 101, a bottom base plate 102, and a set of fitting assemblies 150. The fitting assemblies 150 attach the side base plate 101 and bottom base plate 102. In the preferred embodiment, the mounting system 10 includes two angle assemblies 100, one on each side of the understructure 200.

The side base plate 101 may include several side base plate apertures 103. The side base plate apertures 103 may be somewhat evenly spaced along the side base plate 101. The side base plate 101 may also include a side base plate strip 104. The side base plate strip 104 may be located at an end of the side base plate 101 and protrude above the rest of the side base plate 101. In the preferred embodiment of the side base plate 101 there may be two side base plate strips 104, each located on opposite ends of the side base plate 101.

The bottom base plate 102 may include a bottom base plate aperture 105 and a bottom base plate notch 170. There may be two or more bottom base plate apertures 105 and they may be lineally somewhat evenly spaced along the bottom base plate 102. There may be two or more bottom base plate notches 170 which may be somewhat evenly spaced along the outer bottom base plate 102 (on the side opposite to the one adjacent to the side base plate 101).

Figure 4:
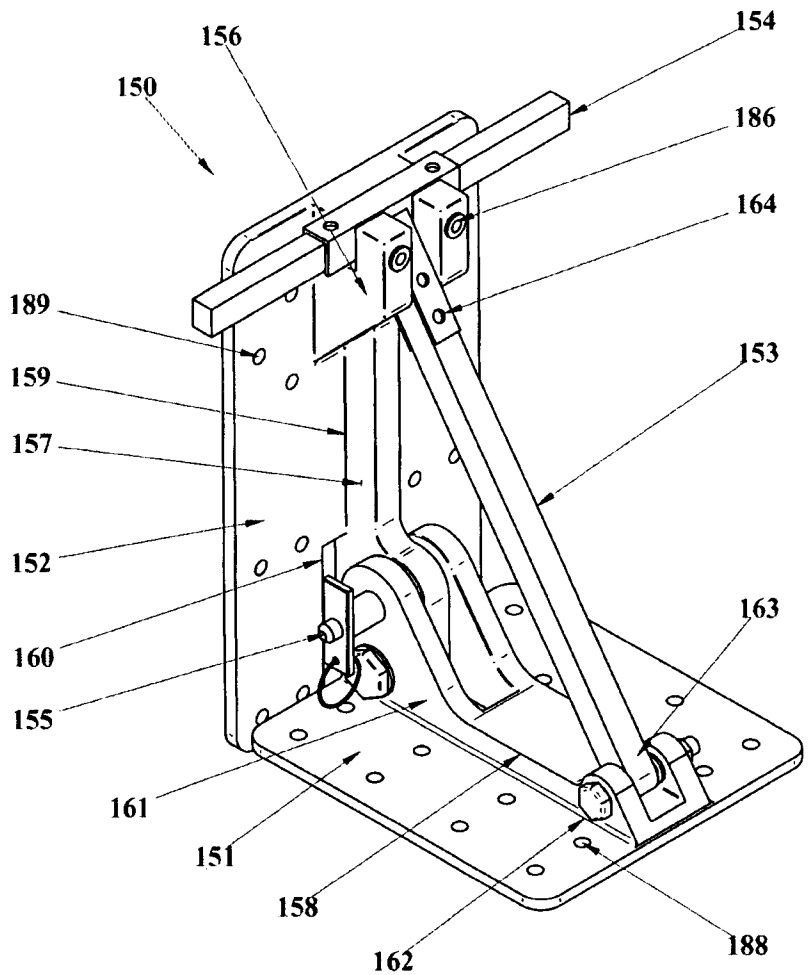
FIG. 4 is a top perspective view of an embodiment of the fitting assembly of the mounting system.

As seen in FIG. 4, the fitting assembly 150 comprises of a bottom plate 151, a side plate 152, and a stiffener brace 153. The bottom plate 151 is attached to the bottom base plate 102, while the side plate 152 is attached to the side base plate 101. The bottom plate 151 may be attached to the bottom base plate 102 by any type of fastener 188, while the side plate 152 may also be attached to the side base plate 101 by any type of fastener 189. The bottom plate 151 is substantially parallel to the bottom base plate 102, while the side plate 152 is substantially parallel to the side base plate 101. In the preferred embodiment, the bottom base plate 102 extends past the bottom plate 151. The stiffener brace 153 is able to brace the bottom plate 151 and the side plate 152 such that the bottom base plate 102 and side base plate 101 are substantially perpendicular to each other when in the extended or open position.

Figure 5A:
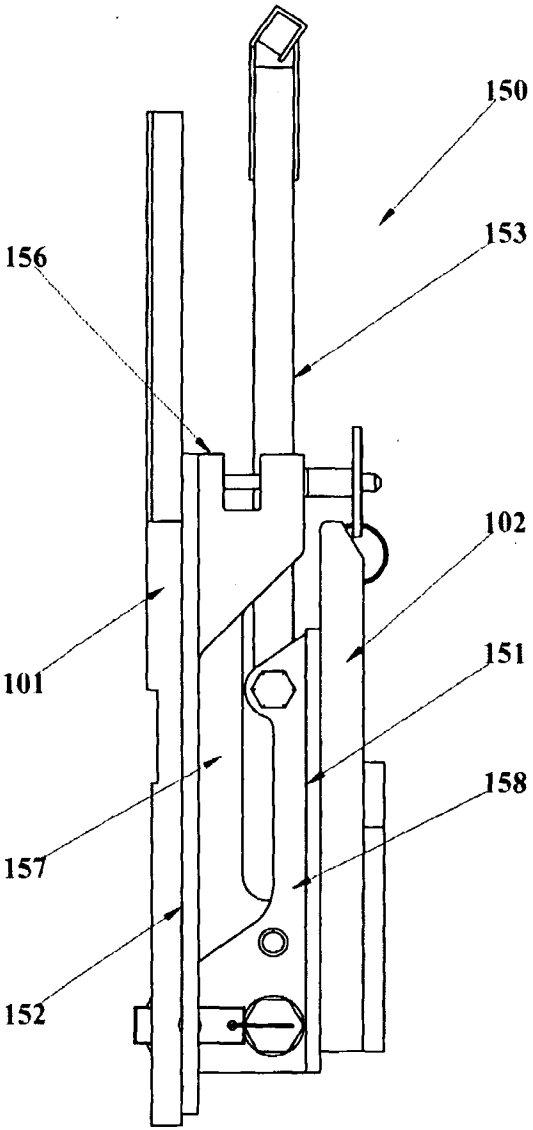
FIG. 5A is a side view of an embodiment of the fitting assembly in the closed or stowed position.
Figure 5B:
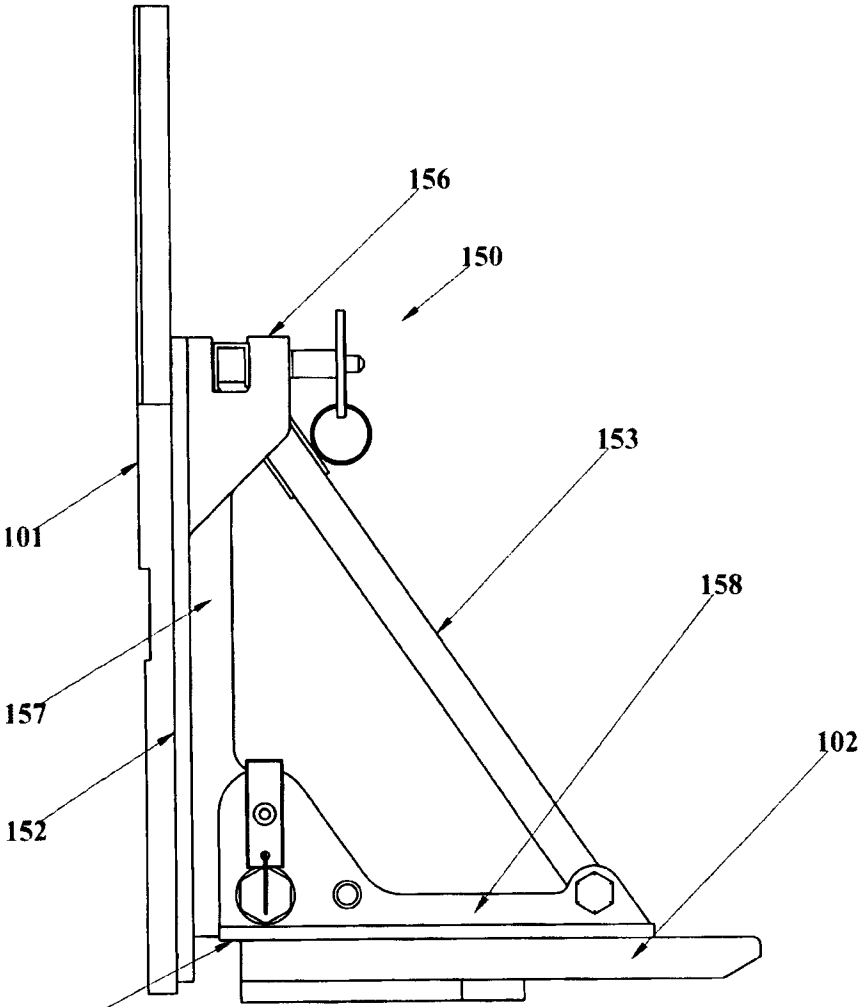
FIG. 5B is a side view of an embodiment of the fitting assembly in the open or extended position.
Figure 7:
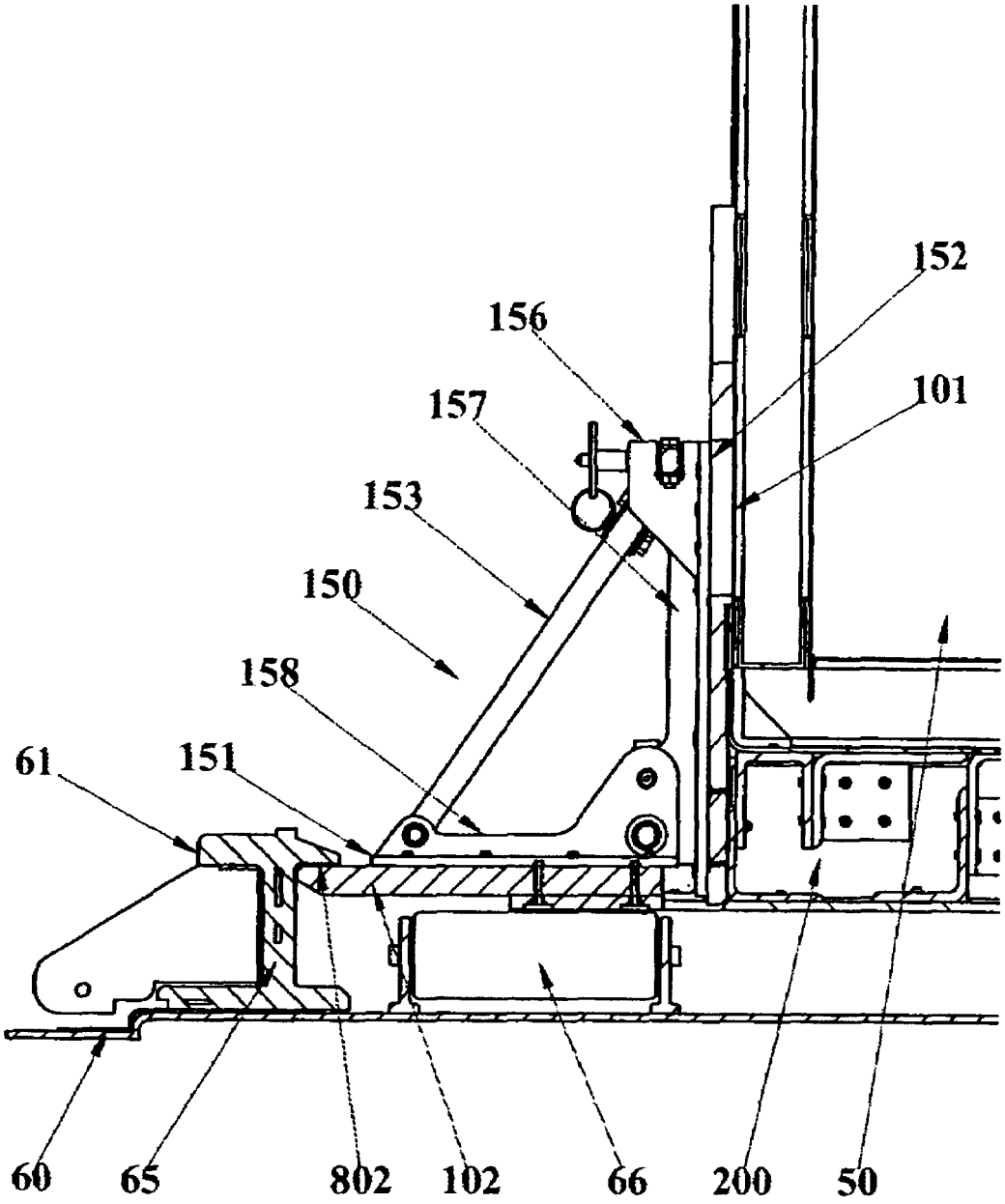
FIG. 7 is side view of a section of an embodiment of the mounting system attached to a standard cargo handling system.

As seen in FIG. 5A, the fitting assembly 150 further includes a closed or stowed position such that the bottom plate 151 (and the bottom base plate 102) and the side plate 152 (and the side base plate 101) are substantially parallel. As seen in FIG. 5B, the fitting assembly 150 includes an open or extended position such that the bottom plate 151 (and the bottom base plate 102) and the side plate 152 (and the side base plate 101) are substantially perpendicular. The closed or stowed position may be utilized in the ground mode while the open or extended position may be utilized in the transport mode. As seen in FIG. 7, in the open or extended position, the mounting system 10 can be used to secure the shelter 50 to a standard aircraft cargo handling system 61 located on the aircraft floor 60. Typically a standard aircraft cargo handling system 61 includes handling system rails 65 and handling system rollers 66. As previously discussed, the bottom base plate 102 may extend past the bottom plate 151, this extended portion 802 may slip under a handling system rail 65 to secure the mounting system to the cabin floor 60.

As shown in FIG. 4, the fitting assembly 150 may also include a stiffener cross bar 154, a lug system 155, and a lug stiffener interface 156. The lug system 155 is attached to the bottom plate 151 and the side base plate 152 such that the bottom plate 151 and the side plate 152 are pivotally attached and can be adjusted from the open (extended) position to the closed (stowed) position and vice versa. The stiffener cross bar 154 is attached to the stiffener brace 153, and the stiffener cross bar 154 communicates with the lug stiffener interface 156 such that the bottom plate 151 and the side plate 152 can be locked in the open position by sliding the stiffener cross bar 154 into the lug stiffener interface 156.

As shown in FIG. 4, the lug system 155 may include a side lug branch 157 and a bottom lug branch 158. The side lug branch 157 is attached to the side plate 152, while the bottom lug branch 158 is attached to the bottom plate 151. They may be attached using any type of fastener. The side lug branch 157 has a first side lug branch end portion 159 and a second side lug branch end portion 160. The bottom lug branch 158 has a first bottom lug branch end portion 161 and a second bottom lug branch end portion 162. The lug stiffener interface 156 is located at the first side lug branch end portion 159. The lug stiffener interface 156 may include forks 186 extending from it in order to stabilize the stiffener cross bar 154 and allow the stiffener cross bar 154 to be able to lock and unlock from the locked position. The second side lug branch end portion 160 is pivotally attached to the first bottom lug branch end portion 161. The second side lug branch end portion 160 and first bottom lug branch end portion 161 may be attached using alignment pins, rotatable bolts, a dowel system, or any means or method that allows pivotal attachment. The second bottom lug branch end portion 162 is pivotally attached to the stiffener brace 153; any means or method that allows pivotal attachment may be used to attach them. The stiffener brace 153 has a first stiffener brace end portion 163 and a second stiffener brace end portion 164. The first stiffener brace end portion 163 is pivotally attached to the second bottom lug branch end portion 162, while the stiffener cross bar 154 is attached to the second stiffener brace end portion 164. The stiffener cross bar 154 may be substantially perpendicular to the stiffener brace 153 and attached to the stiffener brace 153 at the approximate midpoint of the stiffener cross bar 154.

Figure 6:
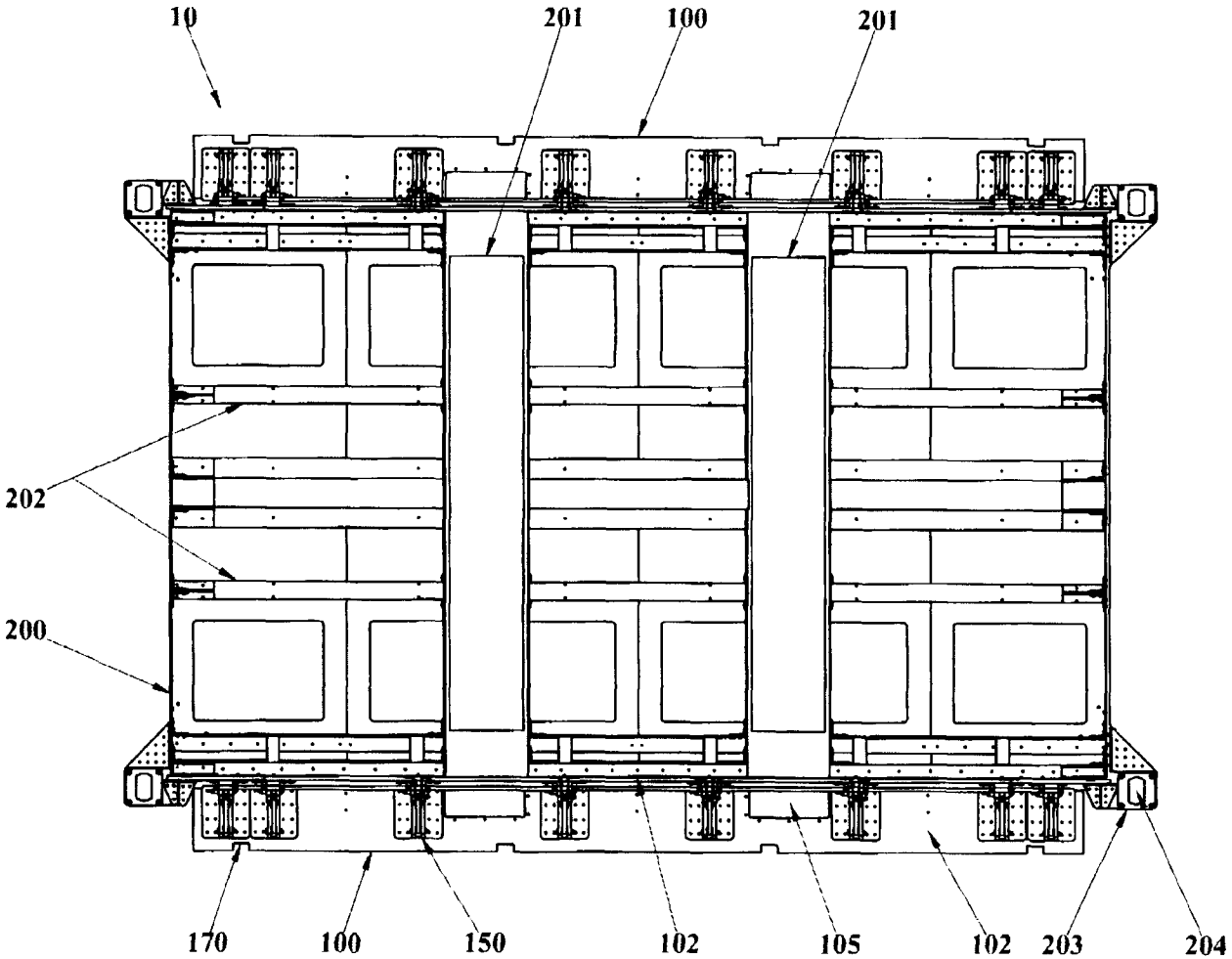
FIG. 6 is a top view of an embodiment of the mounting system.

The understructure 200 may be substantially rectangular; however, it may be any shape. Typically the understructure shape corresponds to the bottom shape of the shelter 50. As seen in FIGS. 1A, 1B, 2, and 6, the two angle assemblies 100 may be located on opposite sides of the understructure 200, particularly on the longer sides of the understructure 200. As seen in FIG. 6, the understructure 200 may include forklift channels 201, roller support beams 202, and mounts 203 at each corner. The mounts 203 may include a mount hole 204 to secure the mounting structure 10 to the floor, vehicle, or to standard aircraft cargo handling rails and detents. The forklift channels 201 may be disposed along the shelter's 50 lateral axis.

The mounting system for a shelter 10 may be manufactured from any material that lends itself to such an application; however, aircraft grade material is the preferred material.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred versions thereof, other versions are possible. Therefore, the spirit and scope of the appended claims should not be limited to the description of the preferred versions contained herein.

What is claimed is:

1. A mounting system for use with a shelter and a transport device, the mounting system, comprising:

a. two self contained angle assemblies, the angle assemblies mountable on longitudinal sides of the shelter, each angle assembly comprises of a side base plate, a bottom base plate, a set of fitting assemblies, the fitting assemblies attaching the side base plate and the bottom base plate to each other, each fitting assembly comprises of a bottom plate, a side plate, a stiffener brace, the bottom plate is attached to the bottom base plate, the side plate is attached to the side base plate, the stiffener brace being able to brace the bottom plate and side plate such that the bottom plate and side plate are substantially perpendicular to each other, the fitting assemblies further include a stowed position such that the bottom base plate and the side base plate are substantially parallel, and an extended position such that the bottom base plate and the side base plate are substantially perpendicular, ah fitting assembly fiber includes a stiffener cross bar, a lug system, a lug stiffener interface, the stiffener cross bar is attached to the stiffener brace, the lug system attached to the bottom base plate and the side base plate such that the bottom base plate and the side base plate are pivotally attached, the stiffener cross bar communicating with the lug stiffener interface such that the bottom base plate and the side base plate can be locked in the extended position, wherein the bottom base plate extends past the bottom plate, the two self contained angle assemblies, when extended, can be used to secure the shelter to standard aircraft cargo handling rails and detents, the two self contained angle assemblies include mounting holes that secure the shelter to vehicles configured with a standard cargo mounting configuration; and, b. a supporting understructure, the shelter mountable on the understructure, the two self contained angle assemblies attached to the understructure on opposite longitudinal sides, the understructure includes forklift channels disposed along the lateral axis of the understructure the understructure has a shape adapted to correspond to the shelter, the mounting system mountable to the transport device, the mounting system is manufactured from aircraft grade material.

* * * * *

UNITED STATES PATENT AND TRADEMARK OFFICE

CERTIFICATE OF CORRECTION

PATENT NO. : 7,036,786 B1
APPLICATION NO. : 10/672273
DATED : May 2, 2006
INVENTOR(S) : Schura It is certified that error appears in the above-identified patent and that said Letters Patent is hereby corrected as shown below:

In column 5, line 5:
-- substantially perpendicular, [ah] each fitting assembly [fiber] further--

In column 6, line 11:
--understructure, the understructure has a shape adapted--

Signed and Sealed this

Twelfth Day of September, 2006

JON W. DUDAS
*Director of the United States Patent and Trademark Office*